US008646897B2

(12) United States Patent
Mori et al.

(10) Patent No.: US 8,646,897 B2
(45) **Date of Patent: *Feb. 11, 2014**

(54) IMAGE FORMING METHOD

(75) Inventors: Hisashi Mori, Tokyo (JP); Hirotaka Iijima, Tokyo (JP); Manabu Kaneko, Tokyo (JP); Masashi Ikeda, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 494 days.

This patent is subject to a terminal disclaimer.

(21) Appl. No.: 12/635,205

(22) Filed: Dec. 10, 2009

(65) Prior Publication Data

US 2010/0149231 A1 Jun. 17, 2010

(30) Foreign Application Priority Data

Dec. 16, 2008 (JP) ..... 2008-319503
Dec. 16, 2008 (JP) ..... 2008-319504

(51) Int. Cl.
*B41J 2/01* (2006.01)

(52) U.S. Cl.
USPC ..... 347/100; 347/96; 347/102

(58) Field of Classification Search
USPC ..... 347/100, 95, 96, 101, 102; 106/31.27, 106/31.6, 31.13; 523/160, 161
See application file for complete search history.

(56) References Cited

U.S. PATENT DOCUMENTS 5,618,338 A * 4/1997 Kurabayashi et al. ..... 347/100
6,084,619 A 7/2000 Takemoto et al.
6,126,281 A * 10/2000 Shimoda et al. ..... 347/102
6,328,438 B1 * 12/2001 Ozawa ..... 347/96
6,620,229 B2 * 9/2003 Doi et al. ..... 106/31.6
6,715,866 B2 * 4/2004 Kasperchik et al. ..... 347/100
7,517,074 B2 * 4/2009 Hakamada et al. ..... 347/100
8,092,874 B2 * 1/2012 Wexler et al. ..... 428/32.3
2003/0069329 A1 * 4/2003 Kubota et al. ..... 523/160

(Continued)

FOREIGN PATENT DOCUMENTS

EP 0581135 7/1993
EP 1 308 491 A2 5/2003

(Continued)

OTHER PUBLICATIONS

Office Action dated Oct. 30, 2012 issued by the Japanese Patent Office in related Japanese Application No. 2008-1319503 and English translation thereof (4 pages).

(Continued)

*Primary Examiner* — Manish S Shah
(74) *Attorney, Agent, or Firm* — Robert P. Michal; Lucas & Mercanti, LLP

(57) ABSTRACT

Provided is a method for forming an image using an ink-jet recording method which forms the image with a single pass printing method employing an ink comprising water in an amount of 20 to 90 weight % based on the total weight of the ink, a pigment and a water soluble resin containing an acidic group which is neutralized with ammonia or an amine compound, the method containing the steps of: applying a processing solution on a coated paper for printing; and ejecting droplets of the ink on the coated paper for printing, wherein the processing solution is capable of aggregating an ingredient of the ink or increasing a viscosity of the ink, and the coated paper for printing is heated from 40 to 60° C. during the step of ejecting the droplets of the ink.

7 Claims, 2 Drawing Sheets

(56) References Cited

U.S. PATENT DOCUMENTS

| | | | | |
|---|---|---|---|---|
| 2006/0203056 | A1* | 9/2006 | Furukawa et al. | 347/96 |
| 2008/0134935 | A1* | 6/2008 | Kunimine et al. | 347/100 |
| 2009/0130320 | A1* | 5/2009 | Kawakami et al. | 347/105 |
| 2009/0195579 | A1* | 8/2009 | Tousi et al. | 347/14 |
| 2010/0245508 | A1* | 9/2010 | Ikeda et al. | 347/95 |

FOREIGN PATENT DOCUMENTS

| | | | |
|---|---|---|---|
| JP | 657192 | | 3/1994 |
| JP | 692009 | | 4/1994 |
| JP | 699576 | | 4/1994 |
| JP | 6128514 | | 5/1994 |
| JP | 71837 | | 1/1995 |
| JP | 820161 | | 1/1996 |
| JP | 9207424 | A | 8/1997 |
| JP | 10287035 | A | 10/1998 |
| JP | 2005306025 | A | 11/2005 |
| JP | 2006007749 | A | 1/2006 |
| JP | 2006248049 | A | 9/2006 |
| JP | 2008208153 | | 9/2008 |
| WO | WO 2008102722 | A1 | 8/2008 |

OTHER PUBLICATIONS

Office Action dated Oct. 30, 2012 issued by the Japanese Patent Office in related Japanese Application No. 2008-1319504 and English translation thereof (4 pages).

* cited by examiner

IMAGE FORMING METHOD

CROSS REFERENCE TO RELATED APPLICATIONS

This application is based on Japanese Patent Application Nos. 2008-319503 filed on Dec. 16, 2008 and 2008-319504 filed on Dec. 16, 2008 with Japan Patent Office, the entire contents of which are hereby incorporated by reference.

TECHNICAL FIELD

The present invention relates to an image forming method which employs an ink-jet recording method. Especially, the present invention relates to a high quality image forming method employing an ink-jet recording method which ejects out an ink and forms an image, after having applied a processing solution which is capable of aggregating the ink ingredients or increasing a viscosity of the ink on the coated paper for printing prior to ejecting the ink thereon.

BACKGROUND

In recent years, since ink-jet recording enables to form an image simply and less expensively, it has been applied to various printing fields such as photography, various types of printing, marking, and special printing such as color filters. Specifically, by employing ink-jet recording apparatuses which eject and control minute ink droplets, ink-jet inks whose range of color reproduction, durability, and ejection adaptability have been enhanced, and paper for ink-jet printing use whose ink-absorbability, color forming properties of colorants and surface glossiness have also been markedly enhanced, it has become possible to provide an image of high quality comparable to conventional silver halide photography.

However, the ink-jet image recording system which requires special paper for ink-jet printing use causes problems such as restriction of recording media usable in the system, and a subsequent cost increase of the recording media.

On the other hand, in an office, it is growing increasingly the need of a system which enables to carry out a full color printing at high speed without receiving restriction of recording media (for example, a plain paper, a coated paper, and an art paper, etc.).

For example, about the ink-jet recording method on a plain paper, it has been performed a various investigation from the viewpoints of: printing at high speed, producing good character reproduction, no generating of the strike-through after printing (phenomenon in which the printed ink passes a recording medium and the picture image is reflected in a wire side), feathering, and a picture image smear.

As one of the methods to resolve the problems, an aqueous ink-jet ink is widely used as an ink for ink-jet. When image recording is performed on plain papers, such as a copy paper for electrophotography, a high quality paper, a medium quality paper, using such aqueous ink-jet ink, there is a problem that curling and cockling (phenomenon in which the surface of the paper becomes wrinkled after getting wet) occur on the plain paper on which carried out image recording.

On the other hand, when printing matters usually produced by offset printing, such as a leaflet, a pamphlet and a flier, are produced with an ink-jet recording method, since it is non-plate printing, reduction of cost or working steps can be realized, and printing from a small batch can be performed with on demand requirement. From this reason, an alternative machine of an offset printing machine by an ink-jet system is called for as a printing press which can perform a small batch printing or on demand printing for business use.

Usually, the coated paper for printing used for offset printing has a coated layer which consists of a white pigment and a binder, such as starch, on the back and front surfaces, by which smoothness and a feeling of gloss are increased.

In the present invention, "a coated paper" designates "a coated paper for printing used for offset printing".

When an aqueous ink-jet ink is used for such paper and an image is formed thereon, the absorption of the aqueous ink in the coated paper is slow.

Therefore, from poor wettability of the Ink-jet ink on the surface of the coated layer, the ink will be gathered on the surface of the coated paper for printing, and there are a problem of producing a spotty pattern (or patchy pattern) and a print mottle (or uneven printing).

On the other hand, high-speed print speed is needed as a printing press which can perform a small batch printing or on demand printing. A single pass type line head ink-jet system is cited as one of the methods of realizing high-speed printing. An ink-jet head having the length more than the width of a print range is called a line head, and it is called a single pass type line head ink-jet system in which all the dots are formed when paper passes once through beneath a line head synchronizing with a paper advance.

The conventional ink-jet printing method allows to move a print head at a right angle to the direction of transportation of media and to scan. Ink dots are formed by repeating a plurality of passes which responded to the scanning width, and an image is created. This method is called a multi-pass type or a scanning type.

The scanning type ink-jet recording method performs printing by repeating a paper advance in an amount of scanning width and scanning movement of the head, while the above-mentioned line mode ink-jet printer does not require scanning movement and it can perform printing by synchronizing with a paper advance. Therefore, the line mode ink-jet printer is suitable for high-speed printing use.

When printing is carried out on a coated paper for printing with a single pass printing method, the jetted dots may cause liquid slippage due to the fact the dots will contact with adjacent dots before absorption, drying, and fixation are performed. As a result, it is hard to obtain a good image compared with the image produce with a multi-pass printing. This liquid slippage contains two steps of: changing of the dot form cause of assembling of the dots; and generating of an uneven density by mutually approaching the liquid inside of a droplet, or a high density area via a surface tension. As a result, the state of an image is deteriorated. Especially, the generating of an uneven density will yield a spotty pattern with a size of 0.1 mm-about several millimeters. Therefore, when no consideration is taken, it will generate remarkable deterioration of image.

Moreover, since the change of the dot form will occur at very short time after contact of the ejected ink dots, it was very difficult to completely prevent from generating the change. Even when the uneven density is prevented completely, due to the change of this dot form, the sharpness of a hollow character will be decreased. Furthermore, when the print pattern which has been applied an image processing especially by an error dispersion method is printed, the obtained image will have a flat shadow in which high-concentration shadow part of 50 or more was evenly printed. This originates from the following fact that the ink surrounding the hollow character of a high density area printed with an error dispersion method will come together, and a reverse dot area (a hollow portion) will be smeared away at random.

It was disclosed a method (for example, refer to Patent Document 1) for improving friction resistance by incorporating a resin neutralized with an amine in the ink so as to warm the media.

However, although this method will avoid mixture of the inks (hereafter it is called as bleeding) or liquid slippage on a non-absorptive medium to some extent, by heating and by the presence of a specific solvent, this method is still insufficient for improvement of image quality of an image produced with the single pass printing.

Moreover, it was disclosed a method (for example, refer to Patent Documents 2 to 7) in which a processing solution was applied on a recording medium before image formation is performed. When a processing solution is used and the quantity of the processing solution is increased, it will increase the aggregation property of the ink and the improvement of the image is induced by it. However, when this method was used for a coated paper for printing applied for the present invention such as a recording medium having high glossiness and low absorptivity, deteriorated glossiness and cockling were big investigational works.

The problems which should be resolves by the present invention are the followings: to avoid decrease of sharpness of an image caused by mutually assembling the dots appeared when the ink dots are printed on a coated paper for printing; and to decrease deterioration of granularity caused by ink gathering and generating the mottle of the ink density.

Further problems to be resolved are: to prevent the smear (hereafter, it is called bleeding) of the ink between the colors generated when printing is performed on the media of low absorptivity at high speed, and also to find out a good image formation method producing an image of high glossiness and good ejection property.

It is hard to achieve the improvement of sharpness of an image even by forming an image with warming a recording medium employing an ink containing a resin neutralized with an amine. This reason is considered as follows: the speed of the viscosity increasing behavior caused only by existence of a resin neutralized with an amines is insufficient for suppressing deformation of the dots produced in a single pass method; and since viscosity increase is performed on a surface of the dots, the viscosity increase has not enough power to stop the deformation of the ink dots when the ink dots are arrived at the recording medium.

Moreover, when an image is formed on a support on which the processing solution capable to aggregate that ink has been preliminarily applied, although an aggregation reaction is high, the aggregating agent will be diffused in the dots by moving from the bottom to the upward and it solidifies the upward of the dots after moving to the upward of the ink dots. The liquid of the upper part of the ink dots will be spread in a wet condition, and the liquid flowed from the adjacent ink dots are contacted, and they are combined with each other, as a consequence, the ink dots are greatly damped and spread. As a result, the effect of suppressing the decrease of sharpness is low. When an amount of a processing solution is increased, the turbulence of an image by the flow of the processing solution, and deterioration of the cockling by increase of fluid volume will occur.

When combining together a printing method using a processing solution and warming the recording medium, evaporation of a processing solution will be promoted by warming of the recording medium the after being applied with the processing solution, and the aggregation effect of the processing solution will be spoiled. For this reason, it is preferable to strike an ink immediately after the application of a processing solution.

In the scanning type printing method, it will take a long time before the ink is struck after applying a processing solution from the structure of the apparatus.

This causes deterioration of aggregation, and also deterioration of image quality, especially when the processing solution is applied on a support having low absorptivity. Because the liquid composition of the processing solution will be changed with evaporation of the liquid and the processing solution itself will exhibit repelling property.

Furthermore, the time after a processing solution is struck until ink reaches media changes greatly with the dots due to the structure of the multi-pass ejection. Therefore, there was a case where the aggregation property of the inks differed for every dot, caused lack of uniformity of the dots, and it led to deterioration of image quality.

On the other hand, in a single pass printing method, the ink dots will reach the target immediately after application of the processing solution due to the structure of the apparatus. The reaching time between the dots will be so small to become a problem. As a result, when a printing method using a processing solution and warming the recording medium are combined together, it can be said that a single pass printing method is superior to a multi-pass printing method.

Patent document 1: JP-A No. 2008-208153
Patent document 2: JP-A No. 6-092009
Patent document 3: JP-A No. 6-099576
Patent document 4: JP-A No. 6-128514
Patent document 5: JP-A No. 7-001837
Patent document 6: JP-A No. 6-057192
Patent document 7: JP-A No. 8-020161

SUMMARY

An object of the present invention is to provide a method for forming an image with an ink-jet recording method. In particular, an object of the present invention is to provide an ink-jet recording method adopting a single pass printing method enabling to produce a printing matter without deterioration of glossiness, having a high sharpness, a decreased granularity and a decreased bleeding even when the printing is made on a small absorptive media such as a coated paper.

The object of the present invention can be achieved with the constitution described below.

1. One of the embodiments of the present invention includes a method for forming an image using an ink-jet recording method which forms the image with a single pass printing method employing an ink comprising water in an amount of 20 to 90 weight % based on the total weight of the ink, a pigment and a water soluble resin containing an acidic group which is neutralized with ammonia or an amine compound, the method comprising the steps of:

applying a processing solution on a coated paper for printing; and ejecting droplets of the ink on the coated paper for printing, wherein the processing solution is capable of aggregating an ingredient of the ink or increasing a viscosity of the ink, and the coated paper for printing is heated from 40 to 60° C. during the step of ejecting the droplets of the ink.

2. Another embodiment of the present invention includes the method of the above-described item 1, wherein an amount of the processing solution applied in the coated paper for printing is 0.5 to 7 ml/m$^2$.

3. Another embodiment of the present invention includes the method of the above-described item 1, wherein the processing solution contains a polyvalent metallic salt.

4. Another embodiment of the present invention includes the method of the above-described item 1, wherein the Processing solution is an aqueous solution containing an organic acid having a pKa value of 5.0 or less.

5. Another embodiment of the present invention includes the method of the above-described item 4, wherein the organic acid in the processing solution has a vapor pressure of 1.0 Pa measured at 25° C.

6. Another embodiment of the present invention includes the method of the above-described item 4, wherein an amount of the organic acid applied to the coated paper for printing during the step of applying the processing solution is 0.025 to 4.0 g/m$^2$.

7. Another embodiment of the present invention includes the method of the above-described item 1, wherein the processing solution contains a resin containing a group having a positive charge.

When the ink-jet recording method of the present invention was used for forming an image, it was found to produce a printing matter without deterioration of glossiness, having a high sharpness, a decreased granularity and a decreased bleeding even when the printing is made on a small absorptive media such as a coated paper.

In the image forming method of the present invention, the bottom of a dot will be solidified via a reaction with a processing solution and, at the same time, the top of a dot will be solidified by an increasing effect of viscosity of resin caused by evaporation of ammonia or an amine compound. Thereby, an ink dot can be hardened so that a dot may be enclosed from the outside part of a dot. As a result, the dot can be hardened efficiently. Therefore, it is supposed that even by using a high-speed printing like a single pass printing, it can be obtained an image which is prevented from occurring density unevenness, low granularity and high sharpness, and almost completely decreased bleeding between colors. Since a dot is hardened only in the outside portion of the dot and it is wrapped with a hardened surface without being hardened the inner portion of the dot. It is possible to fix a dot efficiently compared with hardening the whole dot. The fluidity of the dot can be rapidly restrained. For this reason, it is supposed that required effects which resolve the problems in a high-speed printing can be acquired. Moreover, since the whole of the dot is not hardened, the dot will be flattened in accordance with decrease of the solvent contained in the dot by evaporation or penetration in the recording medium. Consequently, it is supposed that glossiness is not deteriorated even if printing is made on a paper having low absorptivity such as a coated paper for printing.

Moreover, if a processing solution is used so much, deterioration of cackling and the phenomenon of the glossiness on the coated paper for printing will usually be caused, but according to the image formation method of the present invention, the improvement effect of each image can be acquired in a small amount of a processing solution.

DESCRIPTION OF THE PREFERRED EMBODIMENTS

Figure 1:
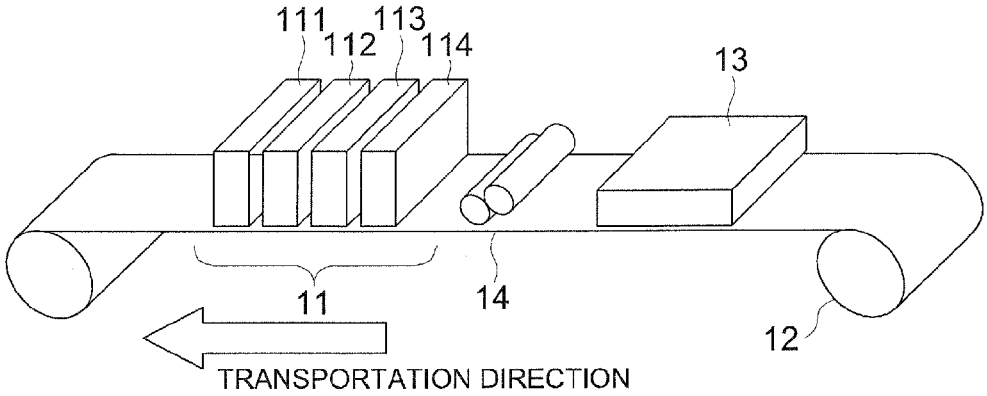
FIG. 1 is an example of a single pass type ink jet printer used for the present invention.

The present invention is an invention in an aqueous ink-jet ink. In the present invention, "an aqueous ink" means that water is included as a main solvent, and does not indicate the water of the minimum quantity which is accidentally contained or dispersed as an additive in an oil system ink or in an alcoholic system ink. Specifically, the aqueous ink of the present invention shall contain 20% or more of water in the ink.

In the present invention, a water soluble resin is dissolved in the ink. This designates the state in which a water soluble resin exists dissolved independently in the ink.

"A water soluble resin" of the present invention indicates a resin which has solubility in water at 25° C. of 2% or more after being neutralized with ammonia or an amine compound. In this case, "dissolution" is different from "dispersion", the aqueous solution of the water soluble resin does not aggregate to form particles, instead, it exists in a homogeneous state. The completely dissolved state of the water soluble resin can be determined as follows: to prepare an aqueous solution of a water soluble resin having 0.5 weight % or less (which may contain an alkali agent used as a neutralizer); to measure a particle size distribution with a dynamic light diffusion particle size distribution analyzer; and to confirm that there is no peak of resin particle size of 2 nm or more. Examples of the dynamic light diffusion particle size distribution analyzer for an aqueous resin solution are commercially available apparatuses such as Zetasizer nonoZS and Zetasizer nonoS (both made by Malvern Instrument Co. Ltd.).

The acid group in the resin will be immediately in a non-dissociation state by an equilibrium reaction in the ink, and it may generate completely or partially a decreased solubility of the resin. As a result, local precipitation of the resin in a molecular level may occur. When such local precipitation occurs for the water soluble resin, it will be re-dissolved immediately. On the other hand, when the resin is attached to a latex or a pigment, the latex and the pigment are made to be aggregated and it is difficult to re-dissolve the attached resin compared with the water soluble resin. For this reason, an aggregated material will be hard to be re-dissolved, and this will cause a deteriorate effect on the storage stability of the ink. As a result of difficult re-dissolution, it may occur adhesion of the ink on a nozzle plate, and since re-dissolution of the ink is difficult, it will cause difficult maintenance work or will produce a wrong ejection orientation. When aggregation occurs by the resin in the pigment, the glossiness of the print will be damaged.

A resin in the present invention which has an acid group neutralized by ammonia or an amine compound is a resin which has an acid group, such as carboxylic acid and a sulfonic acid group, in the resin, and almost total acid groups are neutralized by ammonia or an amine compound. Ammonia has a large evaporation speed and relatively safe, as a result, ammonia is most preferably used for neutralization in the present invention.

The neutralization of the acid group in the water soluble resin is preferably carried out with ammonia or an amine compound. The state in which the acid group in the water soluble resin is neutralized designates a state that at least more than half mol number of the acid group has ammonia or an amine compound as a counter ion. It is more preferable that an equivalent or more of the acid group is neutralized with ammonia or an amine compound.

By evaporation of ammonia or an amine compound by heating during printing, the solubility of the water soluble resin will be decreased. As a result, the ink on the surface of the dot will have an increased viscosity and fixed. This will prevent density unevenness and will result in an improvement of sharpness.

The ink of the present invention has a pH value preferably from 6.5 to 9, and more preferably from 7.5 to 8.5 from the viewpoints of achieving the effects of the present invention and storage stability. In order to achieve the effects of the present invention, the pH adjuster is preferably ammonia or a volatile amine compound. More preferably, the pH adjuster is ammonia.

An amine compound used in the present invention is soluble in water and exhibits an alkali property. It is a compound having one of primary to quaternary amine group. The preferred amine compound is a high volatile amine compound. Specific compounds are amine compounds having a low molecular weight, and in particular, amine compounds having a molecular weight of 120 or less are preferable.

Examples of such amine compounds include: monomethylamine, dimethylamine, trimethylamine, monoethyl amine, diethylamine, triethylamine, methylethylamine, monoethanolamine, diethanolamine, triethanolamine, ethylenediamine, methylaminoethanol and dimethylaminoethanol.

By using ammonia or a volatile amine as a counter of an acid group, ammonia or a volatile amine evaporates immediately in response to the heat of a printing coated paper, and the solubility of the resin decreases. Therefore, a membrane is produced on a dot top surface, the flow of the ink can be prevented. It is assumed that this effect will produce an effect of improvement of an image quality to a great extent.

Specific examples of the resin include: an acrylic system, a styrene-acrylic system, an acrylonitrile-acrylics system, a vinyl acetate-acrylic system, a polyurethane system and a polyester system.

It may be obtained such resins by polymerizing a monomer having an acid group in the molecule.

Examples of these monomers include a radical copolymerization compound of a derivative of: acrylic acid, methacrylic acid, itaconic acid, fumaric acid, and styrene. Moreover, it may be carried out copolymerization with other monomers if needed.

As for the molecular weight of the resin, it is preferable to be 3,000 or more from the viewpoints of improving effect of the image quality of the present invention, and it is preferable to be 30,000 or less from the viewpoints of the ejection property. More preferably, it is from 10,000 to 20,000. Moreover, it is preferable that an acid value is from 60 or more to less than 300.

The molecular weight of the water soluble resin of the present invention designates a weight average molecular weight.

The state in which the resin neutralized by ammonia or an amine compound is dissolved indicates a condition that the water soluble resin is contained in the bulk of the ink without totally adsorbed to the pigment particles.

In order to confirm the amount of the water soluble rein independently dissolved in the ink, a centrifuge can be used. After the solution is subjected to centrifugation at 25 C with 100,000 G, a supernatant is taken and the amount of the water soluble resin in the supernatant can be measured with GPC. An example of a centrifuge is a commercially available one, such as himac CP-WX Series (made by Hitachi Koki CO. Ltd.). A required amount of a water soluble resin depends on the polymerization degree of the resin. However, it is preferably from 2 to 10 weight % of the total weight of the ink, more preferably, it is form 3 to 6 weight %. It is preferably less than the maximum solubility of the water soluble resin. When the amount of a water soluble resin is to small, the effect of the invention will be hard to obtain, and on the contrary, when the amount of a water soluble resin is to large, it will cause abnormal ink-jet ejection or decreased storage stability.

Although the amount of the water soluble resin of the present invention changes depending on the degree of polymerization of the resin, the preferable amount is from 2 to 10% based on the total weight of the ink and, and it is more preferably from 3 to 6%. If the amount of the resin is too small, the effect of the present invention is no longer acquired, and abnormality of the ejection property or storage stability will be caused when the amount of the resin is conversely too large.

These resins are preferably added separately from the resin for pigment dispersion. That is, it is preferable to be added later to a stable pigment dispersion. When an ammonia or amine neutralized resin is dissolved to the solvent in a large amount, a good result can be obtained in respect of glossiness and the maintenance property of the ink.

Examples of the pigment usable in the present invention include those commonly known without any limitation, and either a water-dispersible pigment or an oil-dispersible pigment is usable. For example, an organic pigment such as an insoluble pigment or a lake pigment, as well as an inorganic pigment such as carbon black, is preferably usable.

Examples of the insoluble pigments are not particularly limited, but preferred are an azo, azomethine, methine, diphenylmethane, triphenylmethane, quinacridone, anthraquinone, perylene, indigo, quinophthalone, isoindolinone, isoindoline, azine, oxazine, thiazin, dioxazine, thiazole, phthalocyanine, or a diketopyrrolopyrrole dye.

Specific pigments which are preferably usable are listed below.

Examples of pigments for magenta or red include: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 44, C.I. Pigment Red 149, C.I. Pigment Red 166, C.I. Pigment Red 177, C.I. Pigment Red 178, and C.I. Pigment Red 222.

Examples of pigments for orange or yellow include: C.I. Pigment Orange 31, C.I. Pigment Orange 34, C.I. Pigment Yellow 12, C.I. Pigment Yellow 13, C.I. Pigment Yellow 14, C.I. Pigment Yellow 15, C.I. Pigment Yellow 15:3, C.I. Pigment Yellow 17, C.I. Pigment Yellow 74, C.I. Pigment Yellow 93, C.I. Pigment Yellow 128, C.I. Pigment Yellow 94, and C.I. Pigment Yellow 138.

Examples of pigments for green or cyan include: C.I. Pigment Blue 15, C.I. Pigment Blue 15:2, C.I. Pigment Blue 15:3, C.I. Pigment Blue 16, C.I. Pigment Blue 60, C.I. and C.I. Pigment Green 7.

In addition to the above pigments, when red, green, blue or intermediate colors are required, it is preferable that the following pigments are employed individually or in combinations thereof. Examples of employable pigments include: C.I. Pigment Red 209, 224, 177, and 194, C.I. Pigment Orange 43, C.I. Vat Violet 3, C.I. Pigment Violet 19, 23, and 37, C.I. Pigment Green 36, and 7, C.I. Pigment Blue 15:6.

Further, examples of pigments for black include: C.I. Pigment Black 1, C.I. Pigment Black 6, and C.I. Pigment Black 7.

It is preferable that the pigment used in the invention is dispersed employing a homogenizer together with a dispersing agent and necessary additives for various desired purposes. Commonly known homogenizers are usable, including a ball mill, a sand mill, a line mill, or a high pressure homogenizer.

The average particle size in the pigment dispersion employed in the ink of this invention is preferably from 10 nm to 200 nm, more preferably from 10 nm to 100 nm, and still more preferably from 10 nm to 50 nm. When the average particle diameter in the pigment dispersion exceeds 100 nm, the pigment dispersion becomes unstable. And when the average particle diameter is less than 10 nm, the pigment dispersion becomes unstable, and at the dame time the storage stability of the ink is easily deteriorated.

Particle diameter measurement of the pigment dispersion is carried out with a commercially available particle diameter analyzer employing a light scattering method, an electrophoretic method, or a laser Doppler method. It is also possible to conduct the measurement via photographic particle images of at least 100 particles with a transmission electron microscope, followed by statistically processing these images using an image analyzing software such as Image-Pro (produced by Media Cybernetics, Inc.).

Moreover, apart from a resin neutralized with ammonia or an amine compound as described above, the ink of the present invention may further include other resins for the various purposes. A plurality of these resins may be included and they may be included as a copolymer. It may be possible that these resins are dispersed in the state of the emulsion. When making they are dispersed in the state of an emulsion, it is preferable that they have a particle size of 300 nm or less from the viewpoint of not spoiling ejection property with an ink-jet method. In the case of a soluble polymer, there is no particular limitation in the composition or the molecular weight of the soluble polymer. However, since there is a tendency that the ejection property becomes worse as increasing the degree of polymerization, it is preferable that the polymer has a molecular weight of 50,000 or less, although it may change depending on the composition of the polymer.

As a solvent of the ink which dissolves and disperses the above-mentioned solute, for the purposes of improving the ejection property of the ink or adjusting the ink physical properties, it is preferable that the ink contains water and a solvent ingredient which dissolves in water. As long as the effect of the present invention is not damaged, there is no restriction in particular in the type of solvent. Examples of the solvent include: glycerin, propylene glycol, dipropylene glycol, tripropylene glycol, tetrapropylene glycol, polypropylene glycol, ethylene glycol, diethylene glycol, triethylene glycol, tetraethylene glycol, polyethylene glycols, decaglyserol, 1,4-butanediol, 1,3-butanediol, 1,2,6-hexanetriol, 2-pyrrolidinone, dimethylimidazolidinone, ethylene glycol mono-butyl ether, diethylene glycol monomethyl ether, diethylene glycol monoethyl ether, diethylene glycol monopropyl ether, diethylene glycol mono-butyl ether, triethylene glycol monomethyl ether, triethylene glycol monoethyl ether, triethylene glycol mono-propyl ether, triethylene glycol mono-butyl ether, tetraethylene glycol monomethyl ether, tetraethylene glycol monoethyl ether, propylene glycol mono-butyl ether, dipropylene glycol monomethyl ether, dipropylene glycol monoethyl ether, dipropylene glycol monopropyl ether, diethylene glycol monobutyl ether, tripropylene glycol monomethyl ether, tripropylene glycol monoethyl ether, tripropylene glycol monopropyl ether, tripropylene glycol monobutyl ether, tetrapropylene glycol monomethyl ether, diethylene glycol diethyl ether, diethylene glycol dibutyl ether, triethylene glycol diethyl ether, triethylene glycol dibutyl ether, dipropylene glycol dibutyl ether, tri propylene glycol dibutyl ether, 3-methyl 2,4-pentanediol, diethylene-glycol-monoethyl ether acetate, 1,2-hexanediol, 1,2-pentanediol, and 1,2-butanediol.

It is preferable that the ink of the present invention contains a surfactant so as to improve an ink ejection property or wettability. As a surfactant used, a cationic, anionic, amphoteric, and nonionic surfactant all can be used.

As examples of a surfactant used, although they are not specifically limited, the following can be cited. A cation surfactant: an aliphatic amine salt, an aliphatic quarternary ammonium salt, a benzalkonium salt, benzethonium chloride, a pyridinium salt, an imidazolinium salt. Anionic surfactant: an aliphatic acid soap, an N-acyl-N-methyl glycin salt, an N-acyl-N-methyl-β-alanine salt, an N-acylglutamate, an acylated peptide, an alkylsulfonic acid salt, an alkylbenzenesulfonic acid salt, an alkynaphthalenesulfonic acid salt, a dialkylsulfo succinate, alkylsulfo acetate, α-olefin sulfonate, N-acyl-methyl taurine, a sulfonated oil, a higher alcohol sulfate salt, a secondary higher alcohol sulfate salt, an alkyl ether sulfate, a secondary higher alcohol ethoxysulfate, a polyoxyethylene alkylphenyl ether sulfate, a monoglysulfate, an aliphatic acid alkylolamido sulfate salt, an alkyl ether phosphate salt and an alkyl phosphate salt. Amphoteric surfactant: a carboxybetaine type, a sulfobetaine type, an aminocarboxylate salt and an imidazolium betaine. A nonionic surfactant: a polyoxyethylene secondary alcohol ether, a polyoxyethylene alkylphenyl ether, a polyoxyethylene sterol ether, a polyoxyethylenelanolin derivative polyoxyethylene polyoxypropylene alkyl ether, a polyoxyethyleneglycerine aliphatic acid ester, a polyoxyethylene castor oil, a hydrogenated castor oil, a polyoxyethylene sorbitol aliphatic acid ester, a polyethylene glycols aliphatic acid ester, an aliphatic acid monoglyceride, a polyglycerine aliphatic acid ester, a sorbitan aliphatic acid ester, a propylene glycol aliphatic acid ester, a cane sugar aliphatic acid ester, an aliphatic acid alkanol amide, a polyoxyethylene aliphatic acid amide, a polyoxyethylene alkylamine, an alkylamine oxide, an acetyleneglycol, acetylene alcohol.

It is preferable that a part of these surfactants is furthermore substituted with a fluorine atom or a silicon atom from a viewpoint of reducing the surface tension.

These surfactants and solvents may be used solely, or they may be used in combination of the plural.

<Other Additives>

In order to achieve various purposes, the ink of the present invention may contain various additives. Examples of various properties to be enhanced are: such as ejection stability, adaptability to printing heads and ink cartridges, storage stability, and image retention properties, it is possible, if needed, to appropriately select and employ various types of commonly known additives in the ink of the invention other than those described above. Included are additives such as polysaccharides, a viscosity modifier, a specific resistance controlling agent, a film forming agent, an UV absorbing agent, an antioxidant, an anti-discoloring agent, an antiseptic agent, or an anti-rusting agent. Examples thereof include minute oil droplets of liquid paraffin, dioctyl phthalate, tricresyl phosphate, or silicone oil; UV absorbing agents described in JP-A Nos. 57-74193, 57-87988, and 62-261476; anti-discoloring agents described in JP-A Nos. 57-74192, 57-87989, 60-72785, 61-146591, 1-95001, and 3-13376, as well as optical brightening agents described in JP-A Nos. 59-42993, 59-52689, 62-280069, 61-242871, and 4-219266.

In the present invention, the processing solution which is capable of aggregating the ink ingredients and increasing a viscosity of the ink indicates a liquid which operates on the solid components in the ink and insolubilize them.

For example, by making contact the liquid containing a polyvalent metallic salt with an ink, a counter anion in the pigment or in the resin is blocked and aggregation sedimentation is caused. Although it depends on the choice of the pigment in the ink, or the resin in the ink, as a processing solution which has such a aggregation mechanism, an acidic solution, a cationic resin solution can be cited other than the above-mentioned polyvalent-metallic-salt solution.

As a polyvalent metallic salt, a salt of metal with a valence more than 2 value can be used. As a type of salt, well-known salts can be used. Examples are salts of: carbonic acid, sulfuric acid, nitric acid, hydrochloric acid, an organic acid, boric acid and phosphoric acid. It is also preferable to adjust pH if needed for dissolving the polyvalent metallic salt. As a preferable salt, calcium nitrate, calcium chloride, aluminium nitrate and aluminium chloride are especially cited from points from the viewpoints of achieving the effects of the present invention and handling.

When an acidic liquid is used as a processing solution, it is not especially limited as an acid of the pH adjuster which makes a processing solution acidic. However, when taking into consideration of allowing to react with a carboxylic acid group in the ink, an acid having a pKa value of smaller than 5.0 is preferable, and more preferably, a pKa value is smaller than 4.5.

It is more preferable that the acid is an organic acid than an inorganic acid, when the quality (yellowing of a printed matter, image stability, etc.) of the final printing is taken into consideration. The following acids can be cited as an acid of such a pH adjuster: hydrochloric acid, nitric acid, sulfuric acid, phosphoric acid, carbonic acid, an organic compound having a carboxylic acid group, an organic compound having a sulfonic acid group and an organic compound having a phosphoric acid group. The following acids are specifically more preferable: citric acid, isocitric acid, oxalic acid, maleic acid, fumaric acid, malonic acid, succinic acid, glutaric acid, adipic acid, phthalic acid, isophthalic acid, terephthalic acid, citric acid, 2-pyrrolidone-5-carboxylic acid, benzoic acid, a benzoic acid derivative, salicylic acid, ascorbic acid, malic acid, benzenesulfonic acid, a benzenesulfonic acid derivative, pyruvic acid and oxalacetic acid.

Although there is no restriction in particular as a kind of cationic resins, a resin having a quaternary amine is preferable from the ability to acquire a high effect by a small amount of addition in the processing solution.

As a group which gives a resin cationic property, it is preferable to incorporate a metallic cation or a nitrogen cation in the resin. For example, polyallylamine, polyamine, cation modified acrylate resin, cation modified methacrylic resin, cation modified vinyl resin, cationic polyurethane resin, a copolymer thereof are raised.

It is preferable to dissolve a polyvalent metallic salt, an organic acid having pKa of smaller than 5.0, and a quaternary amine resin as an agent to be incorporated in theses processing solutions. These agents induce high aggregation effect by a small amount of addition. As for the ingredient which causes the aggregation, it is preferable to add in a processing solution in a suitable amount in accordance with the predetermined amount of the ejected ink and the ejected processing solution.

It is preferable to incorporate the compound such as a surfactant or a solvent which adjust the liquid properties other than the above-mentioned compound which aggregates the solid ingredients of the ink or increasing a viscosity of the ink, for the solid content in the above-mentioned ink, if needed.

Examples of the solvent which can be incorporated in the processing solution of the present invention include: water, glycerin, propylene glycol, dipropylene glycol, tripropylene glycol, tetrapropylene glycol, polypropylene glycol, ethylene glycol, diethylene glycol, triethylene glycol, tetraethylene glycol, polyethylene glycols, decaglyserol, 1,4-butanediol, 1,3-butanediol, 1,2,6-hexanetriol, 2-pyrrolidinone, dimethylimidazolidinone, ethylene glycol mono-butyl ether, diethylene glycol monomethyl ether, diethylene glycol monoethyl ether, diethylene glycol mono-propyl ether, diethylene glycol mono-butyl ether, triethylene glycol monomethyl ether, triethylene glycol monoethyl ether, triethylene glycol monopropyl ether, triethylene glycol mono-butyl ether, tetraethylene glycol monomethyl ether, tetraethylene glycol monoethyl ether, propylene glycol mono-butyl ether, dipropylene glycol monomethyl ether, dipropylene glycol monoethyl ether, dipropylene glycol monopropyl ether, diethylene glycol monobutyl ether, tripropylene glycol monomethyl ether, tripropylene glycol monoethyl ether, tripropylene glycol monopropyl ether, tripropylene glycol monobutyl ether, tetrapropylene glycol monomethyl ether, diethylene glycol diethyl ether, diethylene glycol dibutyl ether, triethylene glycol diethyl ether, triethylene glycol dibutyl ether, dipropylene glycol dibutyl ether, tri propylene glycol dibutyl ether, 3-methyl 2,4-pentanediol, diethylene-glycol-monoethyl ether acetate, 1,2-hexanediol, 1,2-pentanediol, and 1,2-butanediol.

In order to adjust the suitable liquid properties for the application method of a processing solution, it is preferable to use plural solvents mixed together. It is specifically preferable, from the viewpoints of coating characteristics, drying characteristics, image quality, and safety, that water is included as a part of solvents.

It is preferable that the processing solution contains a surfactant if needed. As a surfactant which can be used are: a cationic surfactant, an anionic surfactant, an amphoteric surfactant and a nonionic surfactant. For example, the similar surfactants as shown for the ink of the present invention can be also used for a processing solution.

Further, the processing solution may contain a variety of additives for the various purposes. Examples of such additives include: polysaccharides, a viscosity modifier, a specific resistance controlling agent, a film forming agent, an UV absorbing agent, an antioxidant, an anti-discoloring agent, an antiseptic agent, or an anti-rusting agent. Specific examples thereof include: minute oil droplets of liquid paraffin, dioctyl phthalate, tricresyl phosphate, or silicone oil; UV absorbing agents; anti-discoloring agents; and optical brightening agents.

As an application way of a processing solution, any conventionally known methods can be used. Specific examples of an application way include: a roller coating, an ink-jet application, a curtain coating and a spray coating. A roller coating is preferable in respect of the feature that a small liquid volume of application can be easily done. When the application place and the application amount of the processing solution are controlled in accordance with the printing area and the kinds of paper, the application method with an ink-jet method is preferable.

Although an added amount of a processing solution has no restriction in particular, when the amount is too much, a cockling, the turbulence of the image by flowing of a processing solution, or deterioration of glossiness will occur. In order to obtain high image quality, an added amount of a processing solution is preferably from 0.5 to 7 $ml/m^2$, and more preferably from 1.5-4 $ml/m^2$.

A coated paper for printing in the present invention refers to a small water absorptive coated paper which is coated a coating layer which contains a white pigment and a binder such as starch on the back and front of the paper. As a coated paper for printing by which the required effect of the present invention is demonstrated, it is preferable that the amount of transfer of the aqueous solution during 500 is from 0.05 to 6 $ml/m^2$, the aqueous solution being adjusted to have a surface tension of 20 to 40 mN/m using a surfactant.

In the present invention, it is characterized that the surface temperature of the coated paper for printing is heated to from 40 to 60° C. at the time of the ejection of ink on the coated paper. At a temperature lower than 40° C., the effect of the improvement of image quality of the present invention is not acquired. For this reason, it is preferable that a heater for warming a recording medium is equipped as apparatus for performing the image formation way of the present invention.

The surface temperature of the recording medium is preferably to be high so as to achieve the effects of the present invention. On the other hand, since the coated paper for printing contains a cellulose fiber in the interior of the paper, water in the cellulose will be lost by excessive heating and the excessive heating will cause damage to the paper. It will cause deterioration of flatness of the paper or produce curing after printing. From these reasons, although it depends on the kind of the paper, the surface temperature of the recording medium is preferably less than 60° C.

About the heating way of the coated paper for printing application, there may be heated the printing coated paper from a wire side. Moreover, it is preferable to apply the method of heating a top side of the coated paper with infrared radiation, just before the coated paper for printing is conveyed under a head. There is no restriction in particular about the type of a heater, it is preferable to select a required method from well-known ways, such as an infrared heater, an electrically heated wire, UV lamp, gas, and a hot wind dryer. Among them, heating with an electrically heated wire and an infrared heater is more preferable from the point of safety or energy efficiency.

In the ink-jet image recording method of the present invention, ink-jet printing is performed in such a manner that, employing an ink-jet printer loaded with ink-jet inks, ink droplets are ejected from the ink-jet heads based on the digital signals onto a coated paper for printing.

In image formation by ejecting the ink of the present invention, an ink-jet head employed may be either an on-demand type or a continuous type. As an ink ejection system, there may be usable either the electric-mechanical conversion system (e.g., a single-cavity type, a double-cavity type, a bender type, a piston type, a share mode type, or a shared wall type), or an electric-thermal conversion system (e.g., a thermal ink-jet type, or a Bubble Jet type (registered trade name)).

Among them, it is preferable to use a piezo type ink-jet recording head which has a diameter of a diameter of 30 μm or less in the ink-jet recording method of the present invention.

The ink-jet recording method of the present invention is a single pass type ink-jet recording method.

The single pass type ink-jet recording way is an ink-jet recording method with which ink droplets are struck to all of the pixels to be formed only by one passage of a recording medium passing through the beneath of one ink-jet head unit.

As a devise to attain the single pass type ink-jet recording method, it is preferable to use a line head type ink-jet head.

A line head type ink-jet head refers to an ink-jet head having the length more than the width of a printing range. The line head type ink-jet head may have the length of more than the width of a print range with one head, and it may be constructed so that the width of a printing range be exceeded by combining two or more heads as is disclosed in JP-A No. 2007-320278.

Two or more line head type ink-jet heads can also be used for printing one color. In this case, the heads of the same colors are preferably located in adjacent positions. When the heads of the same color are separated, the disproportionation of dots is caused and image quality deterioration is caused because the time from the application of a processing solution to impact of ink dots of the same color will change.

As an order of the color to arrange to form an image composed of yellow, cyan, magenta and black, it is preferable to arrange the head which ejects of the yellow at the end. Although influenced by the aggregation property of the ink for each color, it is more preferable to carry out ejection of the inks in the order of black, cyan, magenta, and yellow.

This is because an aggregating force of a processing solution will be reduced when after-application time passes due to evaporation and during of the processing solution, therefore it is preferable to arrange the head ejecting the light color to the later portion of transportation of the printing medium. The light color will be affected the influence of image quality deterioration to a lesser extent than the deep color.

An example of a preferred apparatus for achieving the image forming method of the present invention is shown below.

Figure 2:
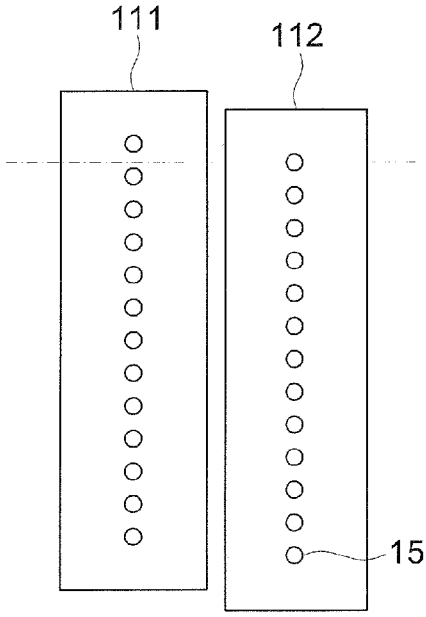
FIG. 2 shows a head unit which is arranged the nozzles alternately.

In FIG. 1, 11 is a head unit. 111-114 each respectively show a head, and the nozzle pitch of each head is 360 dpi. A plurality of nozzle hole 15 of head 111 and head 112, and head 113 and head 114 are alternately arranged as are shown in FIG. 2.

An image having a head width will be printed when the recording paper passes beneath the head unit 111 via transportation mechanism 12.

It is possible to heat the printing paper beforehand with infrared heater 13 with is provided. Roller 14 for applying a processing solution is provided just before a head, a variable amount of the processing solution can be applied depending on a kind of a paper or a required quantity.

Figure 3:
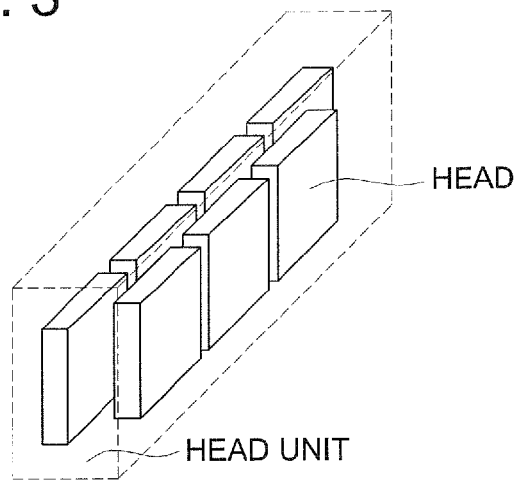
FIG. 3 shows a head unit which is arranged alternately the heads for making a print having a large span.

When making a print span large, it is preferable to carry out by using a plurality of line heads each arranged alternately as shown in FIG. 3.

Figure 4:
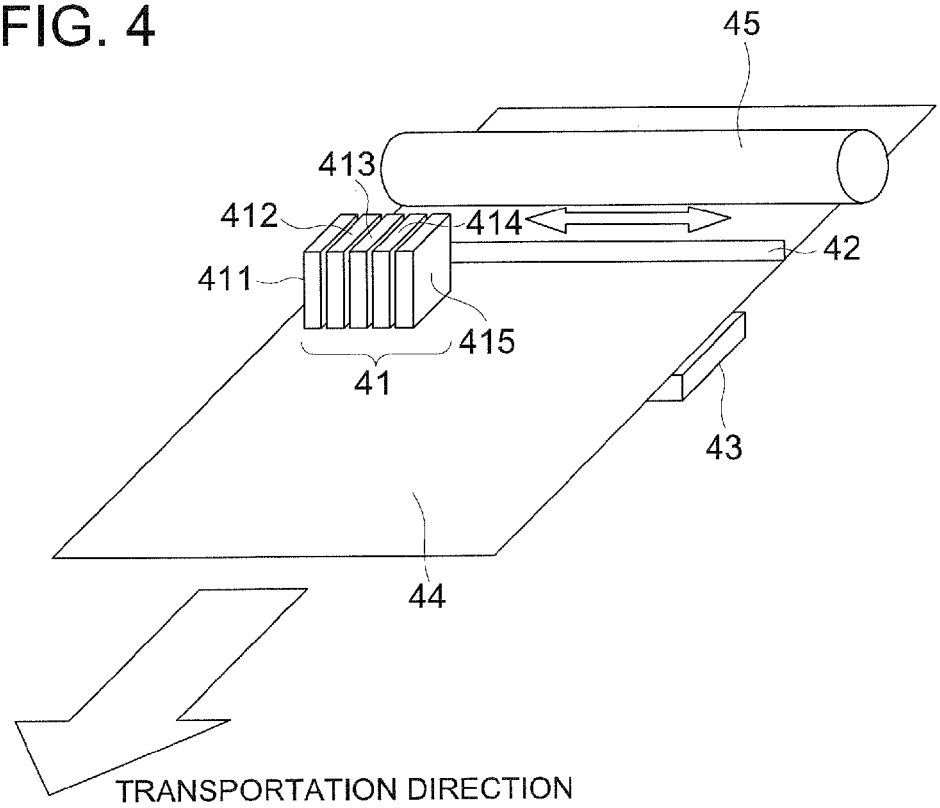
FIG. 4 is an example of a scanning type ink jet printer.

In addition, FIG. 4 shows a comparative scanning type printer. Medium 44 is conveyed to the transportation direction by transport roller 45.

Head unit 41 consisting of heads 411-414 is attached to carriage 42, and is scanned in the right-angled direction of the transportation direction of medium 44. Heater 43 can heat medium 44 from a wire side.

EXAMPLE

The present invention is described below with reference to examples, but the present invention is not limited to these.

[Preparation of Pigment Dispersion]

Preparation of Magenta Pigment Dispersion:

Three weight parts of Joncryl 678 (as a pigment dispersing agent, made by BASF BASF Corporation), 1.3 weight parts of dimethylaminoethanol and 80.7 weight parts of ion exchanged water were stirred with heating to dissolve them and to obtain a solution. To the solution was added 15 weight parts of C.I. Pigment Red 122 and it was premixed. Then, the mixture was dispersed in a sand glider filled with 0.5 mm zirconia beads in an amount of 50% filling ratio to obtain a magenta pigment dispersion having a pigment solid content of 15%.

Preparation of Cyan Pigment Dispersion:

Three weight parts of Joncryl 678 (as a pigment dispersing agent, made by BASF BASF Corporation), 1.3 weight parts of dimethylaminoethanol and 80.7 weight parts of ion exchanged water were stirred with heating to dissolve them and to obtain a solution. To the solution was added 15 weight parts of C.I. Pigment Blue 15:3 and it was premixed. Then, the mixture was dispersed in a sand glider filled with 0.5 mm zirconia beads in an amount of 50% filling ratio to obtain a cyan pigment dispersion having a pigment solid content of 15%.

Preparation of Ink 1-M:

Among the materials described below, the indicated amounts of the materials except the magenta pigment dispersion were mixed, and they were sufficiently stirred. Then, 33 weight parts of the magenta pigment dispersion were added to the mixture with stirring.

After sufficiently stirring, the prepared mixture solution was filtered with a metal filter having a #3,500 mesh. Then, deaeration was carried out using hollow fiber membrane to produce Ink 1-M. Here, JDX 6500 is an acrylic resin neutralized with ammonia.

<Composition of Ink 1-M>

| | |
|---|---|
| Magenta pigment dispersion | 33 weight parts |
| JDX 6500 (made by BASF Corporation) | 10 weight parts |
| E1010 (surfactant) | 0.5 weight parts |
| Propylene glycol | 15 weight parts |
| TEGBE | 5 weight parts |
| Glycerin | 25 weight parts |
| Water | 11.5 weight parts |

Ink 1-C was prepared in the same manner as preparing Ink 1-M by using the following composition of Ink 1-C.

<Composition of Ink 1-C>

| | |
|---|---|
| Cyan pigment dispersion | 33 weight parts |
| JDX 6500 (made by BASF Corporation) | 10 weight parts |
| E1010 (surfactant) | 0.5 weight parts |
| Propylene glycol | 15 weight parts |
| TEGBE | 5 weight parts |
| Glycerin | 25 weight parts |
| Water | 11.5 weight parts |

Ink 2-M and Ink 2-C were prepared in the same way as preparing Ink 1-M by using the following compositions of Ink 2-M and Ink 2-C respectively.

<Composition of Ink 2-M>

| | |
|---|---|
| Magenta pigment dispersion | 33 weight parts |
| E1010 (surfactant) | 0.5 weight parts |
| Propylene glycol | 15 weight parts |
| TEGBE | 5 weight parts |
| Glycerin | 35 weight parts |
| Water | 11.5 weight parts |

<Composition of Ink 2-C>

| | |
|---|---|
| Cyan pigment dispersion | 33 weight parts |
| E1010 (surfactant) | 0.5 weight parts |
| Propylene glycol | 15 weight parts |
| TEGBE | 5 weight parts |
| Glycerin | 35 weight parts |
| Water | 11.5 weight parts |

Ink 1-C and Ink 1-M were used as Ink Set A, and Ink 2-C and Ink 2-M were used as Ink Set B. Ink Set A contains JDX 6500 (made by BASF Corporation) as a resin neutralized with ammonia, while Ink Set B does not contain a resin neutralized with ammonia.

<Preparation of Processing Solution>

The following compositions were mixed and fully stirred. Then the prepared mixture was filtered with a metal filter having a #3,500 mesh. Then, deaeration was carried out using hollow fiber membrane to produce Processing Solution 1.

<Composition of Processing Solution 1>

| | |
|---|---|
| Calcium nitrate | 5 weight parts |
| Glycerin | 30 weight parts |
| Diethylene glycol monobutyl ether | 15 weight parts |
| Polyalkylene glycol lauryl ether | 1 weight part |
| Water | 49 weight parts |

Processing Solutions 2 to 6 were prepared in the same manner as preparing Processing Solution 1, each by using the following compositions.

<Composition of Processing Solution 2>

| | |
|---|---|
| Maleic acid (pKa 1.75) | 5 weight parts |
| Glycerin | 30 weight parts |
| Diethylene glycol monobutyl ether | 15 weight parts |
| Polyalkylene glycol lauryl ether | 1 weight part |
| Water | 49 weight parts |

<Composition of Processing Solution 3>

| | |
|---|---|
| Citric acid (pKa 3.15) | 8 weight parts |
| Glycerin | 30 weight parts |
| Diethylene glycol monobutyl ether | 15 weight parts |
| Polyalkylene glycol lauryl ether | 1 weight part |
| Water | 46 weight parts |

<Composition of Processing Solution 4>

| | |
|---|---|
| Calcium nitrate | 12 weight parts |
| Glycerin | 30 weight parts |
| Diethylene glycol monobutyl ether | 15 weight parts |
| Polyalkylene glycol lauryl ether | 1 weight part |
| Water | 42 weight parts |

<Composition of Processing Solution 5>

| | |
|---|---|
| PAS-21-C1 (secondary polyamine resin, made by Nitto Boseki Co. Ltd.) | 10 weight parts |
| Glycerin | 30 weight parts |
| Diethylene glycol monobutyl ether | 15 weight parts |
| Polyalkylene glycol lauryl ether | 1 weight part |
| Water | 44 weight parts |

<Composition of Processing Solution 6>

| | |
|---|---|
| HAS-H-1L (quaternary polyamine resin, made by Nitto Boseki Co. Ltd.) | 5 weight parts |
| Glycerin | 30 weight parts |
| Diethylene glycol monobutyl ether | 15 weight parts |
| Polyalkylene glycol lauryl ether | 1 weight part |
| Water | 49 weight parts |

The printing conditions of evaluation were as follows.

An ink-jet printer shown in FIG. 1 was used.

Printing resolution: 720 (dpi)×720 (dpi).

Printing was carried out using two heads each having a resolution of 360 dpi and an ejection droplet of 16 pl. The heads were placed in such a manner that the nozzles of each head were alternately arranged as is shown in FIG. 2.

Printing paper: SA Kanefuji and Miller Coat Platinum (both made by Oji Paper Co. Ltd.)

Printing Image: Natural scenery image; and patch image having a printing ratio of 0 to 100%.

Transportation speed of printing paper: 300 mm/s

Printing was performed with the conditions described in Table 1. The temperature of the printing paper was measured with a non-contact type infrared thermometer at the position of a surface of the printing paper just in front of the head.

TABLE 1

| Sample No. | Ink Set | Processing Solution | Added amount of Processing Solution ($ml/m^2$) | Preheating temperature |
|---|---|---|---|---|
| Example 1 | A | 1 | 5 | 45 |
| Example 2 | A | 2 | 5 | 45 |
| Example 3 | A | 3 | 5 | 45 |
| Example 4 | A | 4 | 5 | 45 |
| Example 5 | A | 5 | 5 | 45 |
| Example 6 | A | 6 | 5 | 45 |
| Example 7 | A | 1 | 5 | 55 |
| Example 8 | A | 1 | 6 | 45 |
| Example 9 | A | 1 | 8 | 45 |
| Example 10 | A | 4 | 3 | 45 |
| Example 11 | A | 4 | 1 | 45 |
| Comparative sample 1 | A | none | — | 45 |
| Comparative sample 2 | B | 1 | 5 | 45 |
| Comparative sample 3 | B | 6 | 5 | 45 |
| Comparative sample 4 | B | 1 | 5 | 30 |
| Comparative sample 5 | A | 1 | 5 | 30 |
| Comparative sample 6 | A | 1 | 10 | 30 |
| Comparative sample 7 | A | 1 | 5 | 65 |
| Comparative sample 8 | A | 4 | 5 | 45 |
| Comparative sample 9 | A | 4 | 12.9 | 45 |
| Comparative sample 10 | A | 4 | 5.2 | 45 |

EVALUATIONS

Evaluation of Sharpness

A: The shape of dot remains in a solid image patch having 100 to 50% printing ratio.

B: Partial jointing of dots can be recognized by observation with a microscope, however, the image has no defection when observed with naked eyes.

C: Partial jointing of dots is observed, and there is also observed a strong uneven distribution of an ink depending on the condition of error dispersion.

D: In a high density portion, there is observed a place in which a hollow portion is completely filled. In a medium tone portion, complete jointing of dots is observed, and higher granularity than expected for the resolution is recognized.

Evaluation of Liquid Slippage>

A: No unevenness of density is observed, or there is no jointing of dots.

B: There is no problem in a complete solid image portion. However, in a narrow solid image portion which is formed by jointing of several dots, there is observed a slight unevenness of density.

C: There is observed an unevenness of density in a solid image portion, or there is observed a distinct jointing of several dots in a narrow solid image portion which is formed by jointing of several dots.

<Evaluation of Bleeding>

A: There is observed no bleeding

B: When a 100% solid image is covered on a 100% solid image, the follow of the ink is less than 0.02 mm.

C: When a 100% solid image is covered on a 100% solid image, the follow of the ink is from 0.02 mm to less than 0.05 mm.

D: When a 100% solid image is covered on a 100% solid image, the follow of the ink is 0.05 mm or more.

<Evaluation of Glossiness>

A: There is observed no distinct decrease of glossiness

B: In a print on SA Kanefuji, there is observed no difference of glossiness between the printed portion and the non printed portion. While, in a print on Miller Coat Platinum, there is clearly observed decrease of glossiness in the non printed portion.

C: There is observed decrease of glossiness even in SA Kanefuji.

D: There is observed a rough structure in the printed portion.

<Evaluation of Cockling>

A: There is observed no cocking at all.

B: There is slightly observed cockling when the print is wet, however, the cockling disappears after drying the print.

C: There is slightly observed cockling even after drying the print.

D: There is observed strong cockling, and the head is sometimes touched by the cockling.

Comparative Sample 8

The same image was produced with a scanning type printer shown in FIG. 4 having inks in head 413 and head 414 and applying an Interleave mode.

The printing conditions of evaluation are as follows.

Printing resolution: 720 (dpi)×720 (dpi) (using a head of a resolution of 360 dpi and an ejection droplet of 16 pl; employing a bi-directional printing mode.)

Printing paper: SA Kanefuji and Miller Coat Platinum

Printing Image Natural scenery image; and patch image having a printing ratio of 0 to 100%.

Printing was performed in the same manner as used for producing Example 4.

Comparative Sample 9

The same image was produced with a scanning type printer shown in FIG. 4 having an ink in head 415 and applying an Interleave mode.

The printing conditions of evaluation are as follows.

Printing resolution: 720 (dpi)×720 (dpi) (using a head of a resolution of 360 dpi and an ejection droplet of 16 pl; employing a mono-directional printing mode.)

Printing paper: SA Kanefuji and Miller Coat Platinum

Printing Image Natural scenery image; and patch image having a printing ratio of 0 to 100%.

The same conditions of preheating, the kind of processing solution, and the ink set as Example 4 were adopted. However, the application of the processing solution was done through the ink-jet head evenly without leaving non-printed portion resulting in achieving an added amount of the processing solution to be 12.9 ml/m$^2$.

Comparative Sample 10

An image was produced in the same manner as producing Comparative sample 9 except that the added amount of the processing solution was 5.2 ml/m$^2$ by controlling the printing ratio of the processing solution to be 40%.

The evaluation results of the prints produced by each printing condition are shown in Table 2.

TABLE 2

| Sample No. | Sharpness | Liquid slippage | Bleeding | Glossiness | Cockling |
|---|---|---|---|---|---|
| Example 1 | B | A | A | B | B |
| Example 2 | B | A | A | B | B |
| Example 3 | A | A | A | C | B |
| Example 4 | B | A | A | B | B |
| Example 5 | B | A | A | B | B |
| Example 6 | B | A | A | B | B |
| Example 7 | B | A | A | B | B |
| Example 8 | B | A | A | B | B |
| Example 9 | A | A | A | C | C |
| Example 10 | A | A | A | A | B |
| Example 11 | C | A | B | A | B |
| Comparative sample 1 | D | B | C | A | B |
| Comparative sample 2 | D | B | D | C | B |
| Comparative sample 3 | D | B | D | C | B |
| Comparative sample 4 | D | B | D | C | B |
| Comparative sample 5 | D | B | D | C | B |
| Comparative sample 6 | C | A | B | D | D |
| Comparative sample 7 | C | A | A | C | D |
| Comparative sample 8 | B | B | B | D | B |
| Comparative sample 9 | A | A | A | D | D |
| Comparative sample 10 | D | C | A | D | B |

Comparative samples 8 to 10 were produced using a scanning type printer. Therefore, the printing speed to produce these samples was lower than the inventive samples, Examples 1 to 11. There is a time span from the application of the processing solution to printing the ink for producing Comparative samples. Comparative samples have problems of sharpness, liquid slippage and bleeding. In addition, they have a inferior glossiness. In particular, Comparative sample 9 exhibited cockling cased by a high amount of processing solution applied thereon.

By using the printing method of the present invention, it is possible to produce a print having a high image quality without exhibiting cockling with a single pass printing mode.

What is claimed is:

1. A method for forming an image using an ink-jet recording by an ink, the method comprising the steps of:

forming the image with a single pass printing method;

applying a processing solution on a coated paper for printing;

heating the coated paper to a temperature of 40° to 60° C.; and ejecting droplets of the ink on the heated coated paper which has the temperature of 40° to 60° C. for printing, wherein the ink comprises water in an amount of 20 to 90 weight % based on the total weight of the ink, a pigment and a water soluble resin having an acidic group which is neutralized with ammonia or an amine compound, and wherein the processing solution is capable of aggregating an ingredient of the ink or increasing a viscosity of the ink.

2. The method for forming an image of claim 1, wherein an amount of the processing solution applied in the coated paper for printing is 0.5 to 7 ml/m$^2$.

3. The method for forming an image of claim 1, wherein the processing solution contains a polyvalent metallic salt.

4. The method for forming an image of claim 1, wherein the processing solution is an aqueous solution containing an organic acid having a pKa value of 5.0 or less.

5. The method for forming an image of claim 4, wherein the organic acid in the processing solution has a vapor pressure of 1.0 Pa measured at 25° C.

6. The method for forming an image of claim 4, wherein an amount of the organic acid applied to the coated paper for printing during the step of applying the processing solution is 0.025 to 4.0 g/m$^2$.

7. The method for forming an image of claim 1, wherein the process ng solution contains a resin containing a group having a positive charge.

* * * * *